US006652674B1

(12) United States Patent
Woodard et al.

(10) Patent No.: US 6,652,674 B1
(45) Date of Patent: Nov. 25, 2003

(54) OXIDATION RESISTANT MOLYBDENUM

(75) Inventors: Shiela Rhea Woodard, Manchester, CT (US); Rafael Raban, Ellington, CT (US); James F. Myers, Newington, CT (US); Douglas Michael Berczik, Manchester, CT (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 10/200,474

(22) Filed: Jul. 19, 2002

(51) Int. Cl.[7] ..... C22C 19/03
(52) U.S. Cl. ..... 148/423; 420/429
(58) Field of Search ..... 148/423; 420/429

(56) References Cited

U.S. PATENT DOCUMENTS

| | | | | | |
|---|---|---|---|---|---|
| 3,690,686 | A | * | 9/1972 | Prasse et al. | 277/444 |
| 5,505,793 | A | * | 4/1996 | Subramanian et al. | 148/423 |
| 5,595,616 | A | * | 1/1997 | Berczik | 148/538 |
| 5,693,156 | A | * | 12/1997 | Berczik | 148/407 |

FOREIGN PATENT DOCUMENTS

| | | | | |
|---|---|---|---|---|
| JP | 60-33335 | * | 2/1985 | 420/429 |
| WO | Wo 96/22402 | * | 7/1996 | |

* cited by examiner

*Primary Examiner*—John Sheehan
(74) *Attorney, Agent, or Firm*—Bachman & LaPointe, P.C.

(57) ABSTRACT

Mo—Si—B alloys having additions of a transition element selected from the group consisting of Fe, Ni, Co, Cu and mixtures thereof.

3 Claims, 3 Drawing Sheets

Metal loss after 400 hrs
9 mils ( 9 x $10^{-3}$ inch)
( 229 μm )

OXIDATION RESISTANT MOLYBDENUM

U.S. GOVERNMENT RIGHTS

The invention was made with U.S. Government support under contract F33615-98-C-2874 awarded by the U.S. Air Force. The U.S. Government has certain rights in the invention.

BACKGROUND OF THE INVENTION

The present invention relates to Mo—Si—B alloys and, particularly, Mo—Si—B alloys with improved oxidation resistance due to additions of transition elements selected from the group consisting of Fe, Ni, Co, Cu and mixtures thereof.

Molybdenum has excellent high temperature strength which makes it attractive for structural applications at elevated temperatures. The utility of molybdenum and molybdenum-based alloys however are often limited by their poor elevated temperature oxidation resistance. In an oxidizing environment, the first oxidation product that molybdenum forms is molybdenum trioxide. Molybdenum trioxide has a high vapor pressure and sublimes at substantial rates above 1100° F., resulting in accelerated metal loss from the alloy. Molybdenum and molybdenum-based alloys are therefore largely limited to use in non-oxidizing environments at elevated temperatures without some form of externally applied oxidation protective coating.

U.S. Pat. Nos. 5,595,616 and 5,693,156 disclose a new class of high temperature oxidation resistant molybdenum alloys, Mo—Si—B alloys. In these alloys, the silicon and boron which remain after the initial molybdenum trioxide surface layer volatizes, oxidize to form a protective borosilicate-based oxide scale. If properly processed, these alloys can exhibit mechanical properties similar to other molybdenum-based alloys while also maintaining good oxidation resistance at elevated temperatures (1500° F.–2500° F.). This combination of mechanical properties and oxidation resistance makes these materials very attractive for high temperature structural applications.

The oxidation resistance of these Mo—Si—B alloys is largely a function of the silicon and boron content in the alloy. Increasing the silicon content in the presence of boron, improves the oxidation resistance of the alloy but also results in increased silicide volume fraction. High silicide volume fraction not only makes the alloy difficult to process, it makes it more difficult to achieve mechanical properties equivalent to other molybdenum-based alloys. The '595 patent discloses that quaternary additions of a variety of elements, specifically C, Hf, Ti, Zr, W, Re, Al, Cr, V, Nb and Ta, could improve the oxidation resistance of the Mo—Si—B alloy without increasing the silicide volume fraction. Alloys with the specified quaternary additions exhibited enhanced oxidation resistance at 2200° F. and 2500° F. relative to the ternary Mo—Si—B alloys of equivalent silicide content.

Naturally, it would be highly desirable to further improve the oxidation resistance of Mo—Si—B alloys over a wide range of temperature.

Accordingly, it is a principle object of the present invention to provide an improved Mo—Si—B alloy that exhibits excellent oxidation resistance at elevated temperatures, that is, temperatures in excess of 2200° F.

SUMMARY OF THE INVENTION

The foregoing object is achieved by way of the present invention wherein the oxidation resistance of the ternary Mo—Si—B alloys are improved at elevated temperatures by minor additions of certain transition elements, such as Fe, Ni, Co, Cu. While earlier alloying additions resulted in the formation of an oxide scale which was protective for tens of hours at 2500° F., the described additions result in the formation of an oxide scale which is protective for hundreds of hours (700hrs+) at 2500° F. Minor additions of these elements improve the high temperature oxidation resistance of the alloy without any significant effect on the lower and intermediate temperature oxidation resistance of the alloys.

DETAILED DESCRIPTION OF PREFERRED EMBODIMENT(S)

Figure 1:
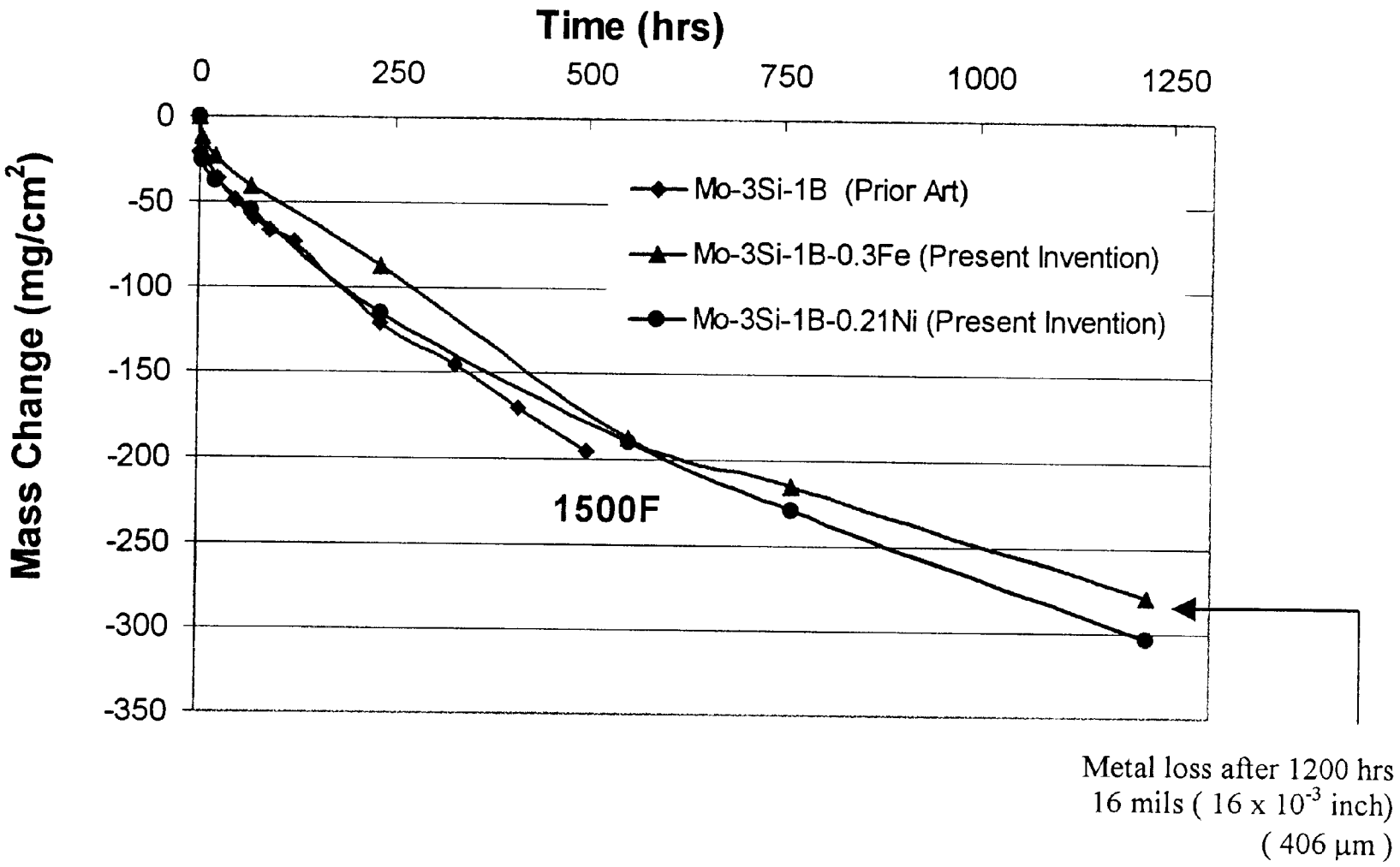
FIG. 1 is a graph illustrating the affect of minor additions of the transition elements of the present invention on oxidation resistance at a temperature of 1500° F.

The Mo—Si—B alloys to which the present invention is drawn are made by combining elements in proportion to the compositional points defined by the points of a phase diagram for the ternary system metal-1.0% Si-0.5% B, metal-1.0% Si-4.0% B, metal-4.5% Si-0.5% B, and metal-4.5% Si-4.0% B, wherein the metal is greater than 50% molybdenum. The molybdenum alloys are composed of body-centered cubic (BCC) molybdenum and intermetallic phases wherein the composition of the alloys are defined by the points of a phase diagram for the ternary system metal-1.0% Si-0.5% B, metal-1.0% Si-4.0% B, metal-4.5% Si-0.5% B and metal-4.5% Si-4.0% B where metal is molybdenum or a molybdenum alloy. Smaller amounts of silicon and boron will not provide adequate oxidation resistance; larger amounts will result in alloys too brittle for structural applications. All percentages (%) disclosed herein refer to weight percent unless otherwise specified. The alloys and their manufacture are disclosed in detail in U.S. Pat. Nos. 5,595,616 and 5,693,156 and these patents are incorporated herein by reference.

In accordance with the present invention, in the foregoing composition ranges, the molybdenum metal component contains one or more of the following transition element additions in replacement of an equivalent amount of molybdenum.

| | WT. % OF ELEMENT IN FINAL ALLOY | |
|---|---|---|
| ELEMENT | BROAD | PREFERRED |
| Fe | 0.01 to 2.0 | 0.05 to 1.0 |
| Ni | 0.01 to 2.0 | 0.10 to 1.0 |
| Co | 0.01 to 2.0 | 0.05 to 1.0 |
| Cu | 0.01 to 2.0 | 0.01 to 1.0 |

In the present invention, the oxidation resistance of the ternary Mo—Si—B alloys are improved over a wide range of temperatures by minor additions of the transition elements. While earlier alloying additions resulted in the formation of an oxide scale which was protective for tens of hours at 2500° F., the described additions result in the formation of an oxide scale which is protective for hundreds of hours (700hrs+) at 2500° F. Minor additions of these elements improve the high temperature oxidation resistance without any deleterious effect on the lower and intermediate temperature oxidation resistance in this class of alloys. The beneficial affects of the described minor additions is not limited to alloys with these elements in quaternary additions, it also includes combinations of these additions and alloys with these additions in combination with higher order (5th and 6th element) additions.

The improved oxidation resistance of the alloys of the present invention will be made clear from the following Example.

EXAMPLE

Research grade materials were prepared by arc-melting 75–100 grams of the constituents and casting them in a chilled copper hearth. These cast specimens were crushed to powder and consolidated in a hot iso-static press (HIP). Consolidated Mo—Si—B material was then sectioned and exposed in an air furnace at the designated temperatures with measurements taken periodically during the exposure to determine weight loss trends. Additionally, the thickness of the specimen was recorded in the pre-exposed conditions and after the final exposure to determine the thickness loss. The beneficial affects of the minor transition element additions are not limited to alloys manufactured by the described technique. The improved oxidation resistance has been documented in material produced from other processing methods.

Figure 2:
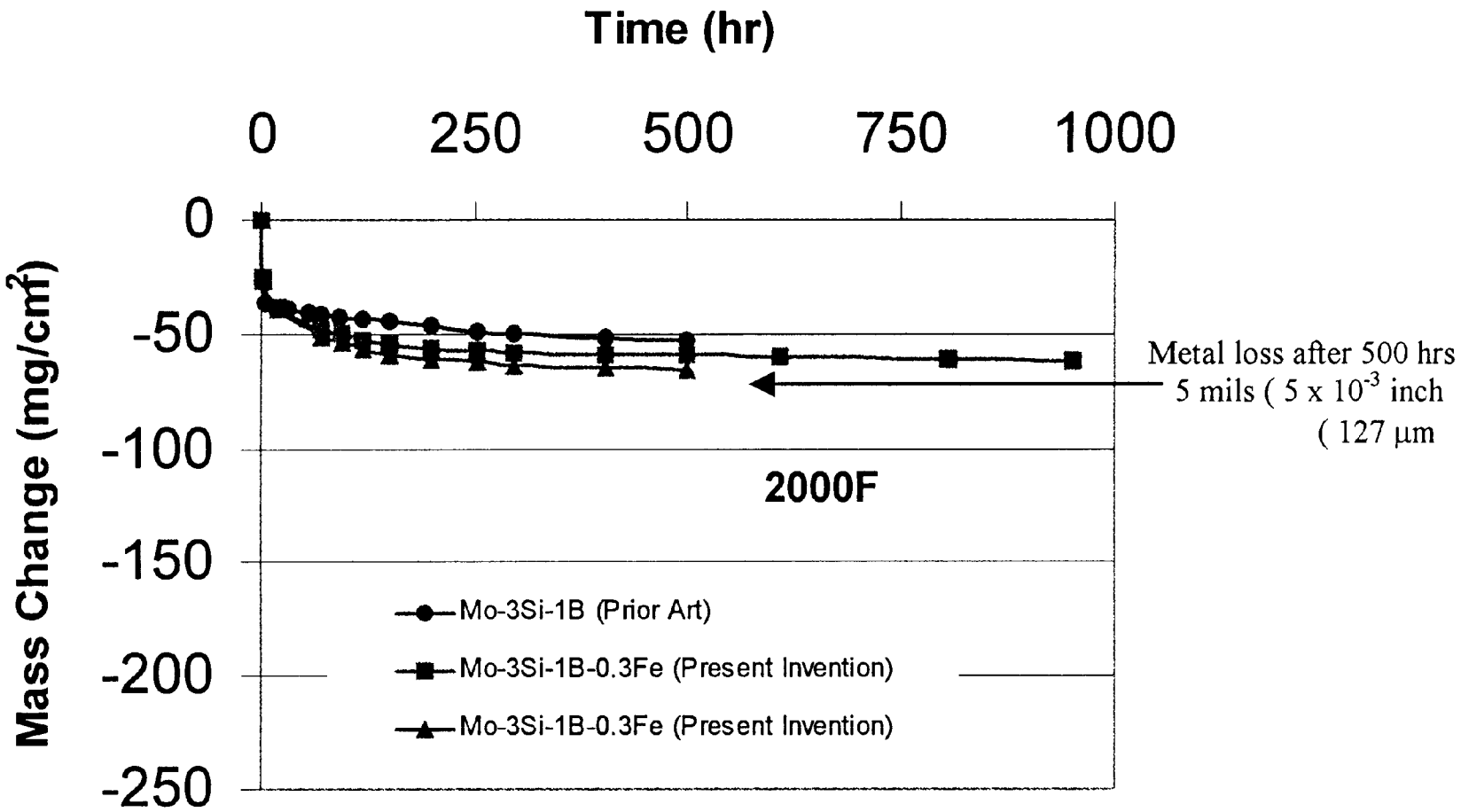
FIG. 2 is a graph illustrating the effort of minor additions of the transition elements of the present invention on oxidation resistance at a temperature of 2000° F.
Figure 3:
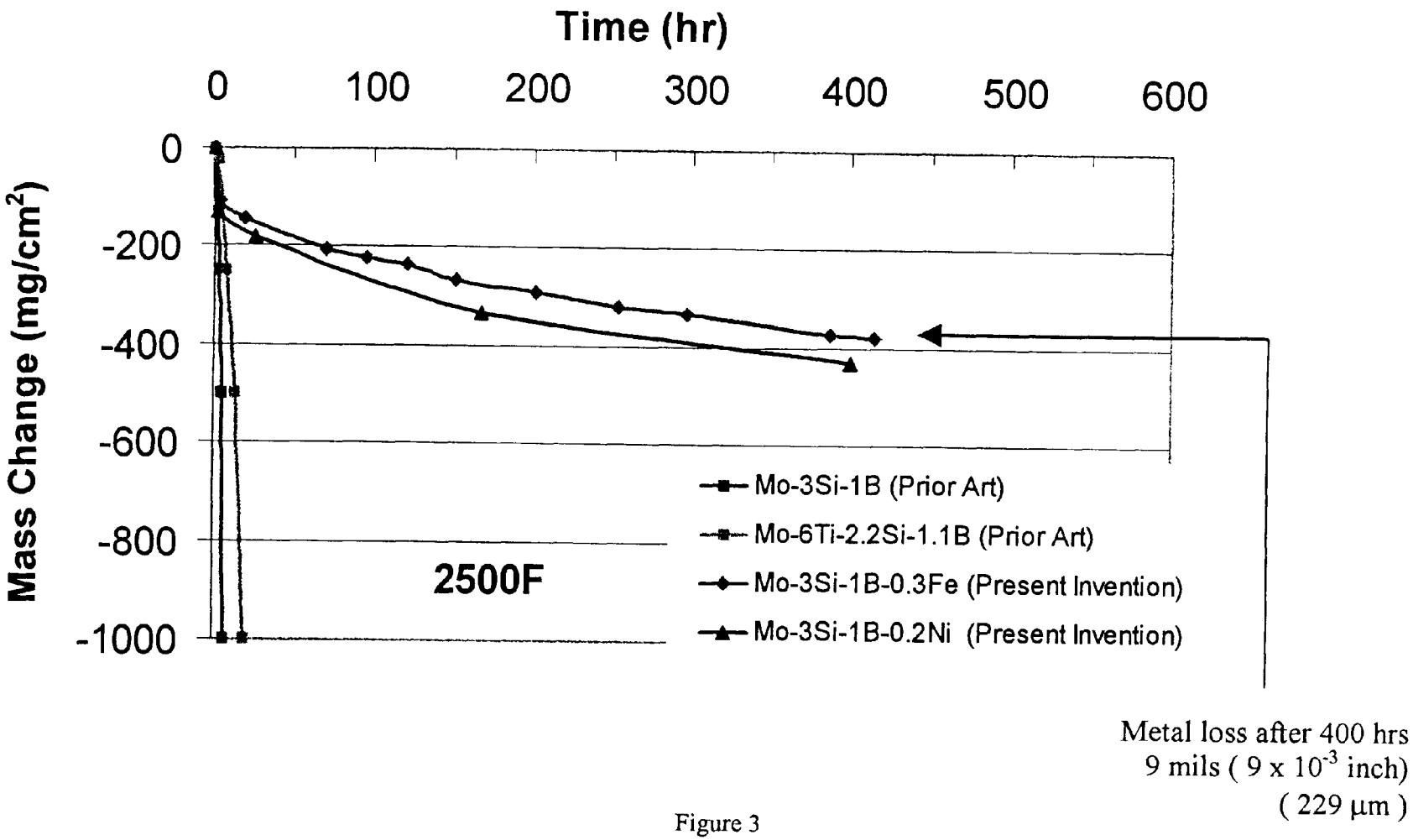
FIG. 3 is a graph illustrating the effort of minor additions of the transition elements of the present invention on oxidation resistance at a temperature of 2500° F.

The weight loss trends that these types of alloys exhibit are illustrated in FIGS. 1, 2 and 3. As can be seen from the Figures, the alloys of the present invention provide significant improved oxidation resistance when compared to prior art alloys, particularly at elevated temperatures in excess of 2000° F. over extended time periods.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. Molybdenum alloys composed of body centered cubic molybdenum and intermetallic phases wherein said alloys consist essentially of a composition defined by the area described by the compositional points of the phase diagram for a ternary system: molybdenum-1.0% Si-0.5% B, molybdenum-1.0% Si-4.0% B, molybdenum-4.5% Si-0.5% B, and molybdenum-4.5% Si-4.0% B, wherein percentages are weight %, and further comprises at least one element in replacement of molybdenum in the stated quantity and selected from the group consisting of;

Fe 0.01 to 2.0 wt.%

Ni 0.01 to 2.0 wt.%

Co 0.01 to 2.0 wt.%

Cu 0.01 to 2.0 wt.%.

2. The molybdenum alloy of claim 1 comprising at least one element in the stated quantity selected from the group consisting of:

Fe 0.05 to 1.0 wt.%

Ni 0.10 to 1.0 wt.%

Co 0.05 to 1.0 wt.%

Cu 0.01 to 1.0 wt.%.

3. Molybdenum alloys composed of body centered cubic molybdenum and intermetallic phases wherein said alloys consist essentially of a composition defined by the area described by the compositional points of the phase diagram for a ternary system: molybdenum-1.0% Si-0.5% B, molybdenum-1.0% Si-4.0% B, molybdenum-4.5% SI-0.5% B, and molybdenum-4.5% Si-4.0% B, wherein percentages are weight %, and further comprises an element selected from the group consisting of Fe, Ni, Co, Cu and mixtures thereof, wherein the content of the one or more element is less than or equal to 8.0 weight %.

* * * * *